US012287173B2

(12) United States Patent
Ilgun

(10) Patent No.: US 12,287,173 B2
(45) Date of Patent: Apr. 29, 2025

(54) SHORT STROKE PUMP-ACTION SHOTGUN

(71) Applicants: Burak Ilgun, Atasehir/Istanbul (TR); KAYHAN AV TUFEKLERI SAN. VE DIS TIC. LTD. STI., Atasehir/Istanbul (AR)

(72) Inventor: Burak Ilgun, Atasehir/Istanbul (TR)

( * ) Notice: Subject to any disclaimer, the term of this patent is extended or adjusted under 35 U.S.C. 154(b) by 365 days.

(21) Appl. No.: 17/789,548

(22) PCT Filed: Dec. 4, 2020

(86) PCT No.: PCT/TR2020/051231
§ 371 (c)(1),
(2) Date: Jun. 28, 2022

(87) PCT Pub. No.: WO2021/137804
PCT Pub. Date: Jul. 8, 2021

(65) Prior Publication Data
US 2023/0037366 A1 Feb. 9, 2023

(30) Foreign Application Priority Data
Dec. 31, 2019 (TR) ..... 2019/23129

(51) Int. Cl.
*F41C 7/02* (2006.01)
*F41C 23/16* (2006.01)

(52) U.S. Cl.
CPC ..... *F41C 7/02* (2013.01); *F41C 23/16* (2013.01)

(58) Field of Classification Search
CPC ..... F41C 7/02; F41C 23/16
See application file for complete search history.

(56) References Cited

U.S. PATENT DOCUMENTS

| | | | | | |
|---|---|---|---|---|---|
| 422,327 | A * | 2/1890 | Odkolek | F41A 3/32 | 42/70.07 |
| 2,006,642 | A * | 7/1935 | Johnson | F41C 7/02 | 42/2 |
| 3,471,961 | A * | 10/1969 | Lewis | F41A 3/18 | 42/20 |
| 7,526,887 | B2 * | 5/2009 | Engel | F41C 7/04 | 42/16 |
| 10,274,274 | B2 * | 4/2019 | Kwon | F41A 9/24 | |
| 2015/0300772 | A1 * | 10/2015 | Carson | F41C 23/14 | 42/17 |
| 2018/0142975 | A1 | 5/2018 | Hoon | | |
| 2019/0154382 | A1 | 5/2019 | Pizano | | |
| 2019/0212081 | A1 | 7/2019 | Cox | | |

OTHER PUBLICATIONS

International Search Report and Written Opinion in International Application No. PCT/TR2020/051231, dated Apr. 30, 2021.

* cited by examiner

*Primary Examiner* — Michelle Clement
(74) *Attorney, Agent, or Firm* — Raphael Bellum PLLC

(57) ABSTRACT

The present invention relates to a short stroke (operation distance) pump-action shotgun comprising a mechanism that reduces consequently the reloading path and reloading time approximately by 65 percent. The speed repeating faster is achieved, while firing with a pump-action shotgun and hunting rifle and furthermore, a better precision is ensured. The inventive shotgun may be a pump-action shotgun or pump-action hunting shotgun.

14 Claims, 8 Drawing Sheets

SHORT STROKE PUMP-ACTION SHOTGUN

TECHNICAL FIELD

The present invention relates to a short stroke (operation distance) pump-action shotgun comprising a mechanism that reduces consequently the reloading path and reloading time approximately by 65 percent. While firing with the short stroke (operation distance) pump-action shotgun, a faster repetition may be achieved, wherein a better precision and a faster muzzle velocity may be achieved by means of this shotgun.

STATE OF THE ART

Pump action is a manual-reloaded firing arm operation rotating by means of a sliding mechanism after a firing process to discharge the used ammunition, namely the shotgun shell at every turn and to chamber the next round. Pump action exhibits a revolution by means of pumping the forearm after firing. Forearm moves by means of a part named as action rods that fastens the bolt apparatus on the slide. This performs the process steps of the bolt and causes the same to move together with the forearm. There are two movements to pump a shotgun. First, the forearm is pulled back. This initially unlocks the bolt and then, when the bolt moves backwards, it discharges the fired shotgun shell or ammunition. When the forearm reaches the end of the backward operation distance, it is pushed in the opposite direction, namely forward. It pulls the bolt together with itself, until the bolt is relocked completely in the forward position. During its forward movement, the bolt takes a new ammunition or shotgun shell from a magazine or tubular magazine and pushes it into the chamber and lock its position. Thus, the shotgun is ready to be fired again.

Pump action shotguns are shotguns manually driven. All current pump-action shotguns comprise a forearm fastened on the slide and it moves backwards at the same total distance of the slide apparatus as to disconnect the slide and discharge the fired shotgun shell or ammunition and chamber another one.

In the prior art, the patent application US 2015/0113848 A1 relates to a firearm comprising the following; a barrel, a handguard disposed around the barrel; a manually operated pump-action reload mechanism, the pump-action reload mechanism comprising a hand-held actuation arrangement and a fore-end body, the fore-end body disposed around the barrel between the handguard and the barrel, and the hand-held actuation arrangement coupled to the fore-end body to operate the pump-action reload mechanism.

There is currently the need for a pump-action shotgun overcoming the disadvantages in the state of the art and the insufficiency of the present solution necessities to perform an improvement in the related technical field. The present invention relates to a short stroke (operation distance) pump-action shotgun comprising a mechanism that reduces the reloading path and consequently the reloading time by means of the movement of the gearwheel on the slides.

BRIEF DESCRIPTION and OBJECTS OF THE INVENTION

The present invention relates to a short stroke (operation distance) pump action shotgun in the shotgun and rifle form and comprises a gearwheel for shortening the reloading path.

In the present invention, it is not required to push the forearm pump backwards with the same distance of the bolt apparatus length during the pumping action. Because the wheel with the smaller diameter rotates the wheel with the greater diameter on the gearwheel by means of the short movement of the action rod and it operates on the long tensile slide that moves the bolt apparatus backwards.

An object of the present invention is to reduce the forearm movement and the path and consequently the reloading time. There is a gearwheel that is rotated slightly. However, it exhibits a significant movement to achieve a faster possible pumping action in the inventive pump action shotgun.

Said gearwheel reduces the path and consequently the time (reloading time) in all pump-action shotguns.

An advantage of the present invention are as follows:

- a faster repetition (reloading) speed while firing,
- a better precision and faster firing rates while firing together with minor movements and effects resulting from the shotgun vibration,
- allowing shooter for his/her arm move movements during the stages of discharging and reloading the shotgun with less effort and difficulty.

DESCRIPTION OF THE COMPONENTS OF THE INVENTION

Components in Figures are numbered so as to provide a better understanding of the inventive pump-action shotgun and equivalent of each number is given below:

| | |
|---|---|
| 1 | Barrel |
| 2 | Bead front sight |
| 3 | Bolt release |
| 4 | Barrel cover |
| 5 | Body |
| 6 | Gearwheel system |
| 6a | Gearwheel with greater diameter |
| 6b | Gearwheel with smaller diameter |
| 7 | Retainer pin |
| 8 | Mechanism |
| 9 | Needle |
| 10 | Needle spring |
| 11 | Needle pin |
| 12 | Body lever |
| 13 | Body pin |
| 14 | Body pin |
| 15 | Bolt head |
| 16 | Extractor |
| 17 | Pushing spring |
| 18 | Pusher |
| 19 | Pushing pin |
| 20 | Extractor pin |
| 21 | Extractor spring |
| 22 | Barrel extension |
| 23 | Barrel extension pin |

-continued

| | |
|---|---|
| 24 | Long tensile slide |
| 25 | Short tensile slide |
| 26 | Action pipe |
| 27 | Action rod pin |
| 28 | Bolt arm pin |
| 29 | Nut screw |
| 30 | Nut |
| 31 | Nut pin |
| 32 | Forearm |
| 33 | Bolt arm |
| 34 | Absorber |
| 35 | Forearm O-Ring |
| 36 | Magazine |
| 37 | Stock setscrew |
| 38 | Stock |
| 39 | Safety |
| 40 | Safety spring capsule |
| 41 | Safety spring |
| 42 | Safety pin |
| 43 | Trigger guard |
| 44 | Trigger guard |
| 45 | Trigger guard pin spring |
| 46 | Magazine button |
| 47 | Magazine button spring |
| 48 | Magazine button pin |
| 49 | Locking arm |
| 50 | Locking arm spring |
| 51 | Trigger |
| 52 | Trigger pin |
| 53 | Trigger spring |
| 54 | Interior trigger |
| 55 | Interior trigger spring |
| 56 | Cock |
| 57 | Cock pin |
| 58 | Cock spring |
| 59 | Cock spring capsule |

DETAILED DESCRIPTION OF THE INVENTION

Figure 1:
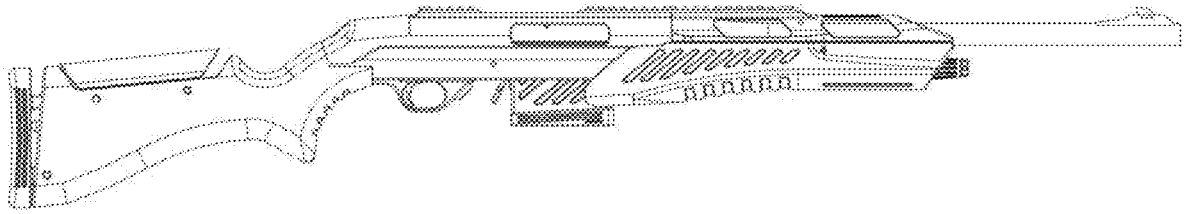
FIG. 1 is a perspective view of the pump-action shotgun.
Figure 2:
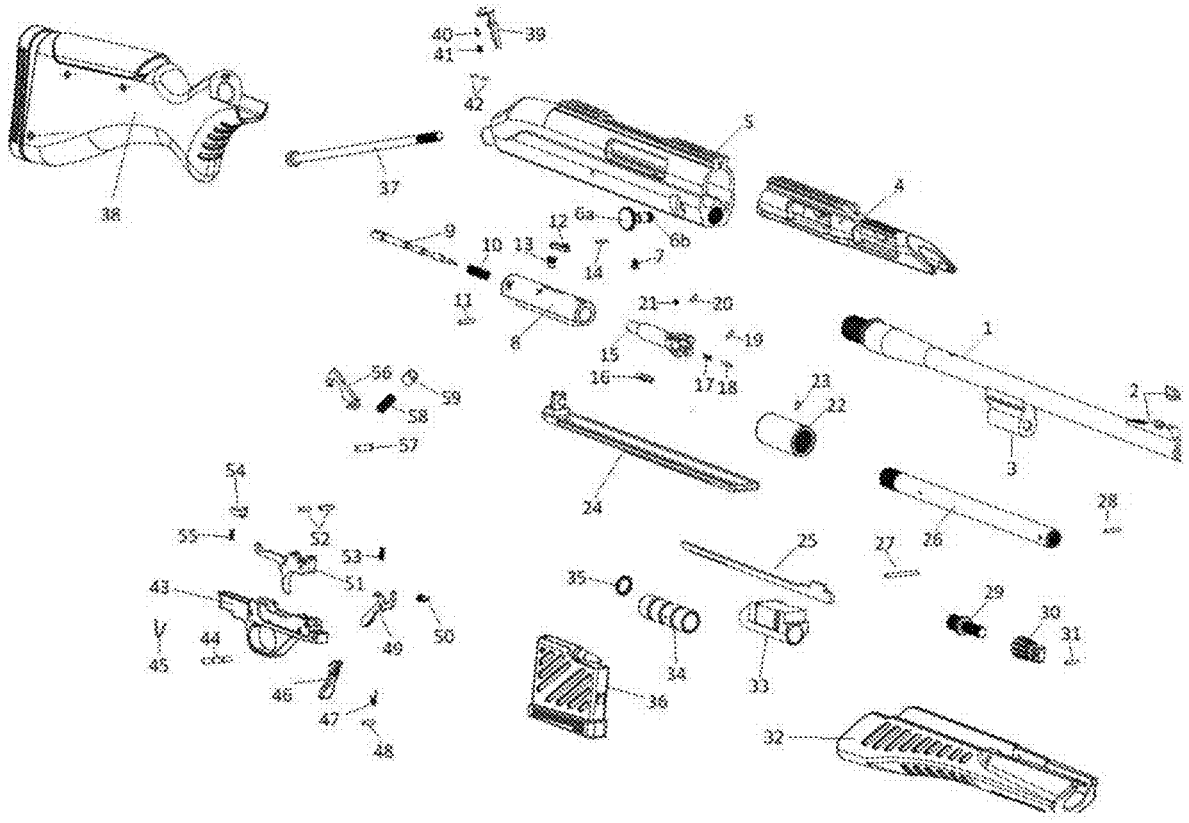
FIG. 2 is an exploded view of the pump-action shotgun.
Figure 3:
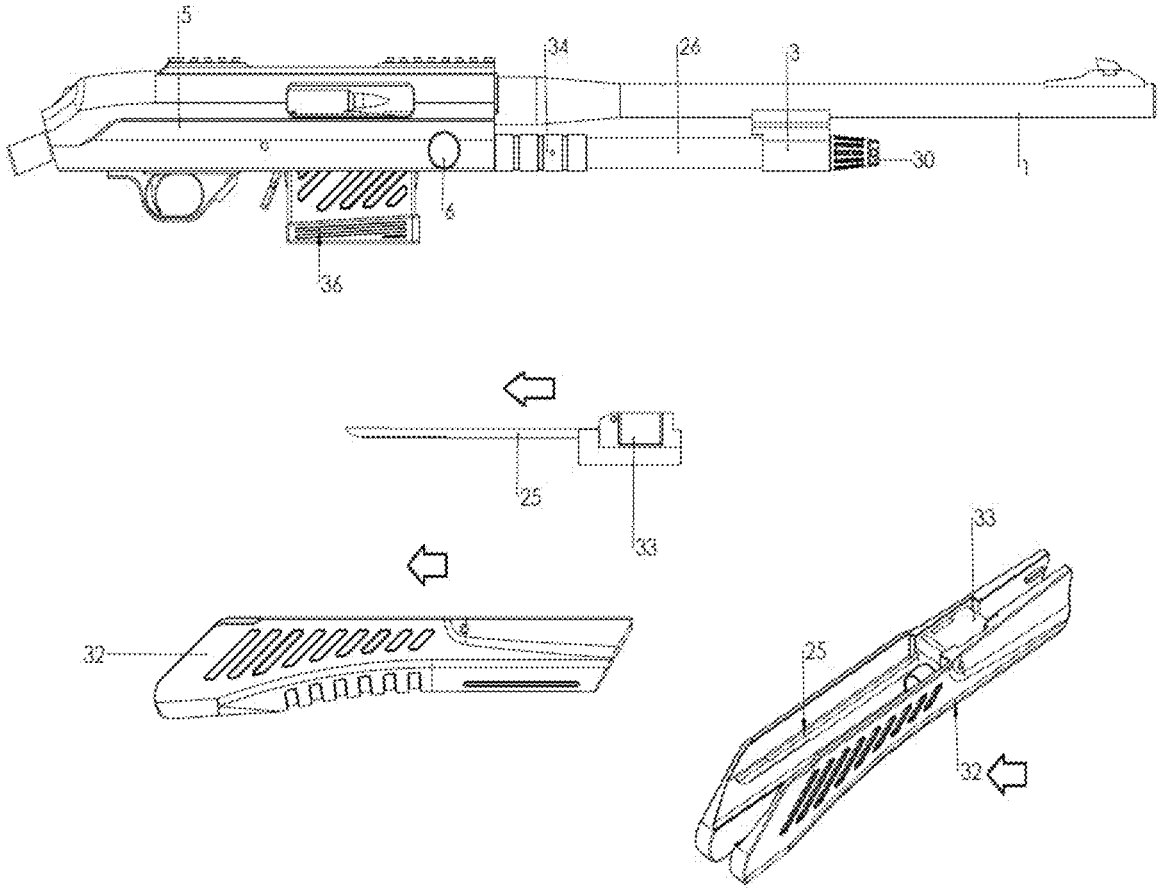
FIG. 3 is a view of the pump-action shotgun during the pumping process.
Figure 4:
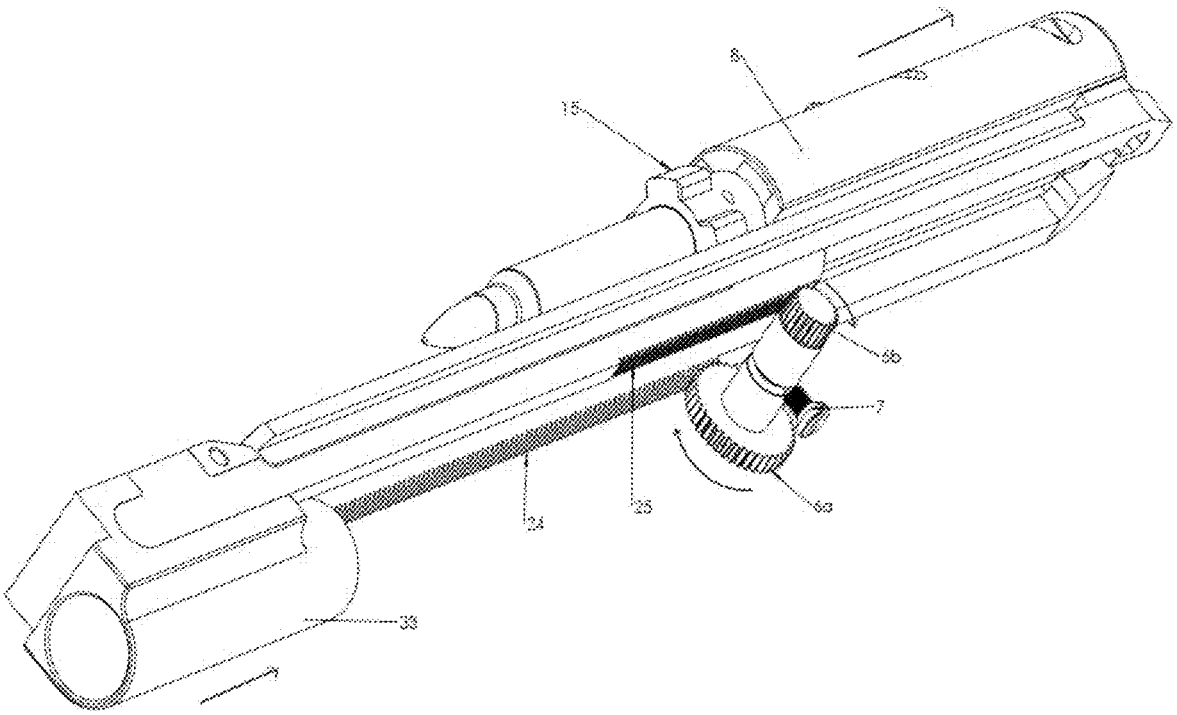
FIG. 4 is a view of the pump-action shotgun illustrating the operation principle of the gearwheel on the tensile slides.

The present invention relates to a short stroke (operation distance) pump-action shotgun comprising a mechanism that reduces the reloading path and consequently the reloading time by means of the movement of the gearwheel system (6) operating co-centrally and comprising gearwheel with two different diameters, short stroke (operation distance) pump-action shotgun, characterized in that it comprises a gearwheel system (6) that allows for reducing the forearm movement and path in pump-action shotguns and consequently also reducing the reloading time and that is fastened on the receiver (5) by a retainer pin (7) operating on the long tensile slide (24) short tensile slide (25) and which operates co-centrally and comprises two gearwheels in different diameters. Said gearwheel system (6) comprises two different gearwheels with two different diameters on the long tensile slide (24) and short tensile slide (25). FIG. 4 shows where said gearwheel system (6) is positioned and how the gearwheel system (6) comprising the gearwheel (6*b*) with smaller diameter and the gearwheel (6*a*) with greater diameter operates on the gearwheel system (6).

Said pump-action shotgun (hunting shotgun or rifle) may be suitable for any calibers in the firearm market. Said shotgun may be a shotgun with a rifled barrel or without a not-rifled barrel.

Pump-action shotgun comprises a gearwheel system (6) between the short tensile slide (25) fastened to the bolt arm (33) and the long tensile slide (24) moving the bolt (8). On the gearwheel system (6), it comprises two wheels with different diameter, namely the gearwheel (6*b*) with smaller diameter and the gearwheel (6*a*) with greater diameter. The gearwheel (6*b*) with smaller diameter operates on the short tensile slide (25) fastened by means of the bolt arm (33) on the forearm (32). The gearwheel (6*a*) with greater diameter is connected with the long tensile slide (24) fastened to the mechanism (8) and moving the same.

The operation mechanism of the inventive pump-action shotgun comprises the following steps:

i. moving the forearm (32) backwards by shooter for the pumping action, which causes the bolt arm (33) mounted to the forearm (32) and fastened to the short tensile slide (25) to move backwards approximately by 50 mm, ii. rotating the gearwheel (6*b*) on the short tensile slide (25) and transmitting the movement to the gearwheel (6*b*) with greater diameter operating on the long tensile slide (24), when the bolt arm (33) starts to move backwards by pulling the forearm (32) backwards, iii. locking the bolt by means of moving the mechanism (8) fastened on the long tensile slide (24) backwards approximately by 120 mm and extracting the spent ammunition by this movement, iv. unlocking the shotgun and making the same ready for chambering the new ammunition, v. moving again the forearm (32) forwards approximately by 50 mm, causing the mechanism (8) to move forwards by 120 mm and also to chamber the new ammunition from the magazine (36), vi. locking the shotgun and making the same ready to be fired.

Figure 5:
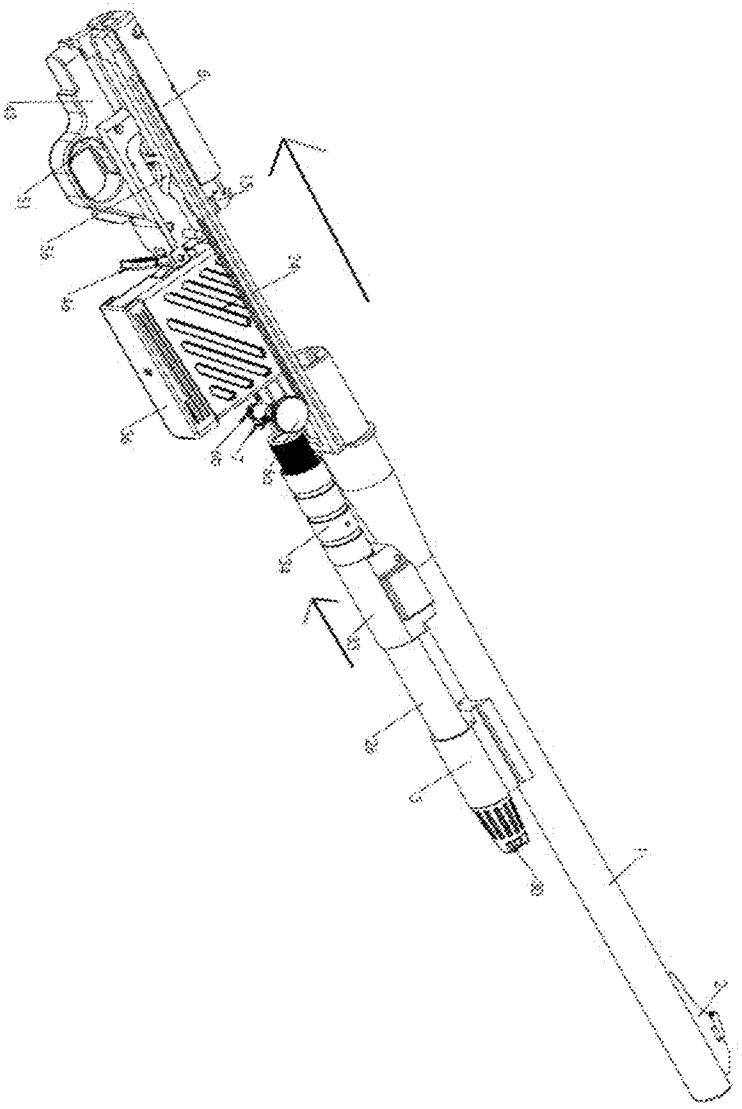
FIG. 5 is a right-side view of the pump-action shotgun.
Figure 6:
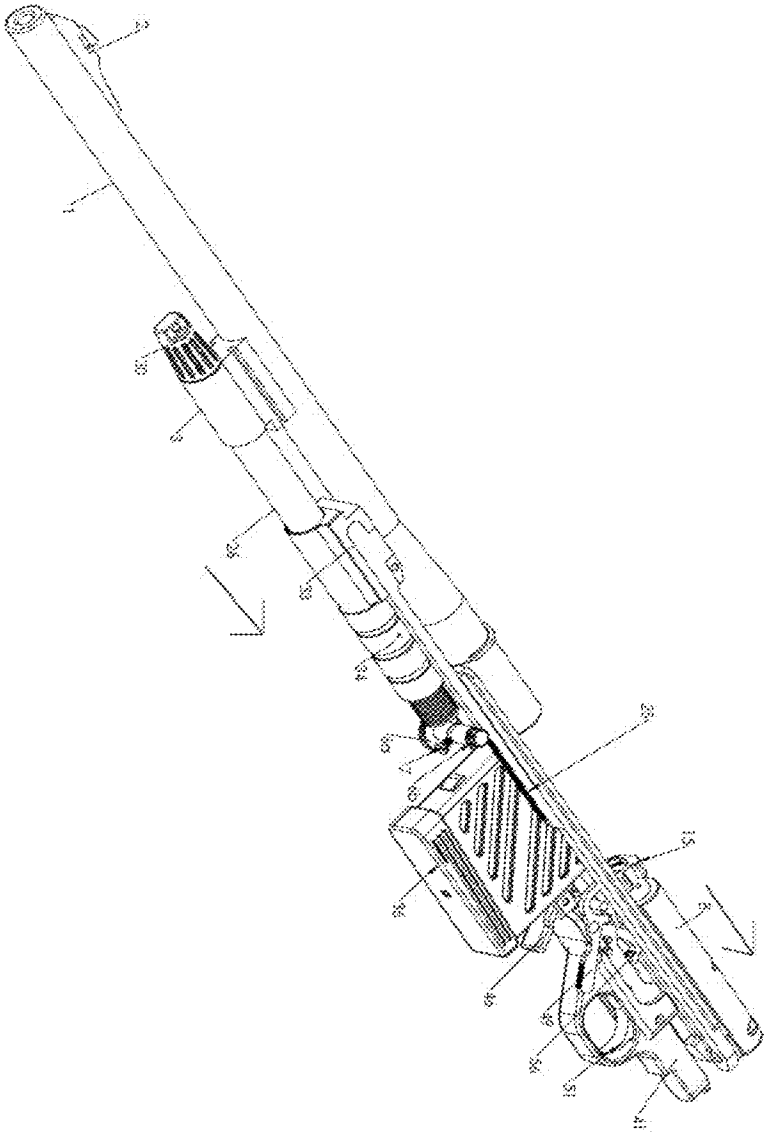
FIG. 6 is a left-side view of the pump-action shotgun.
Figure 7:
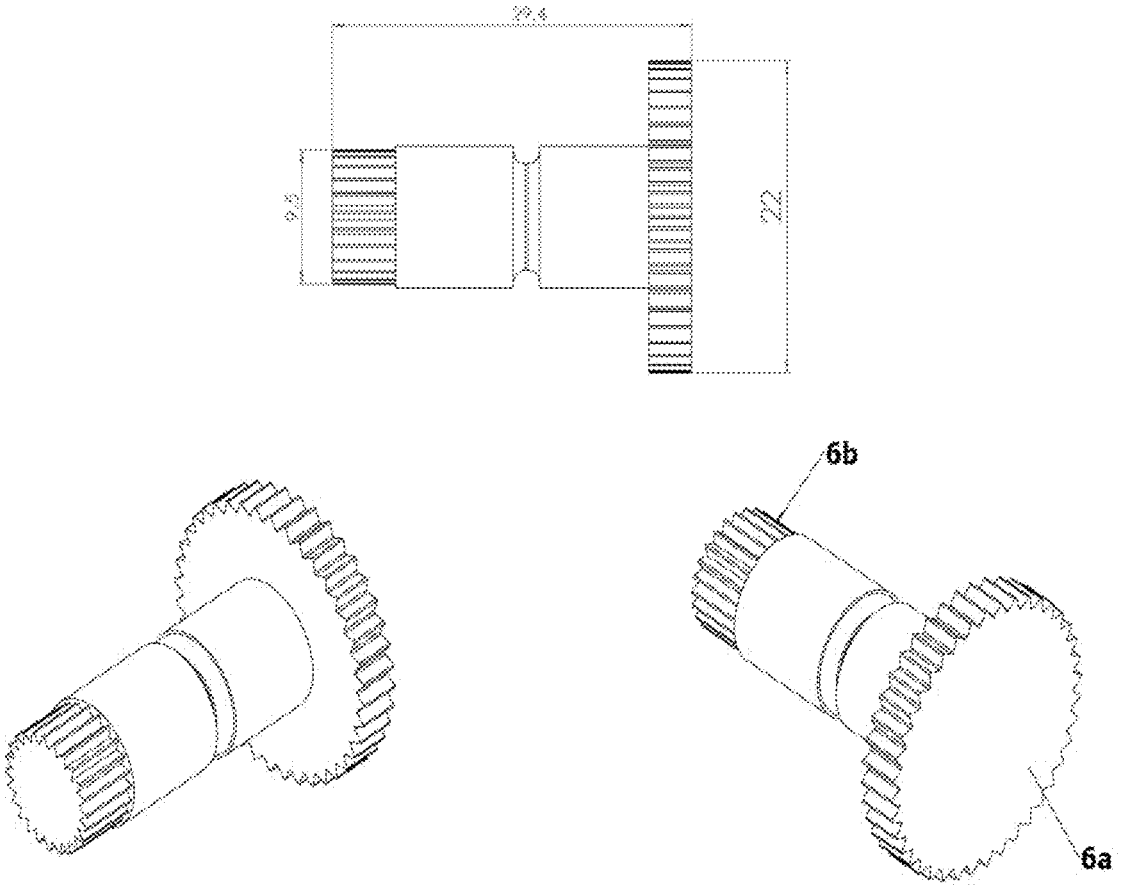
FIG. 7 shows different views of the gearwheel of the pump-action shotgun.
Figure 8:
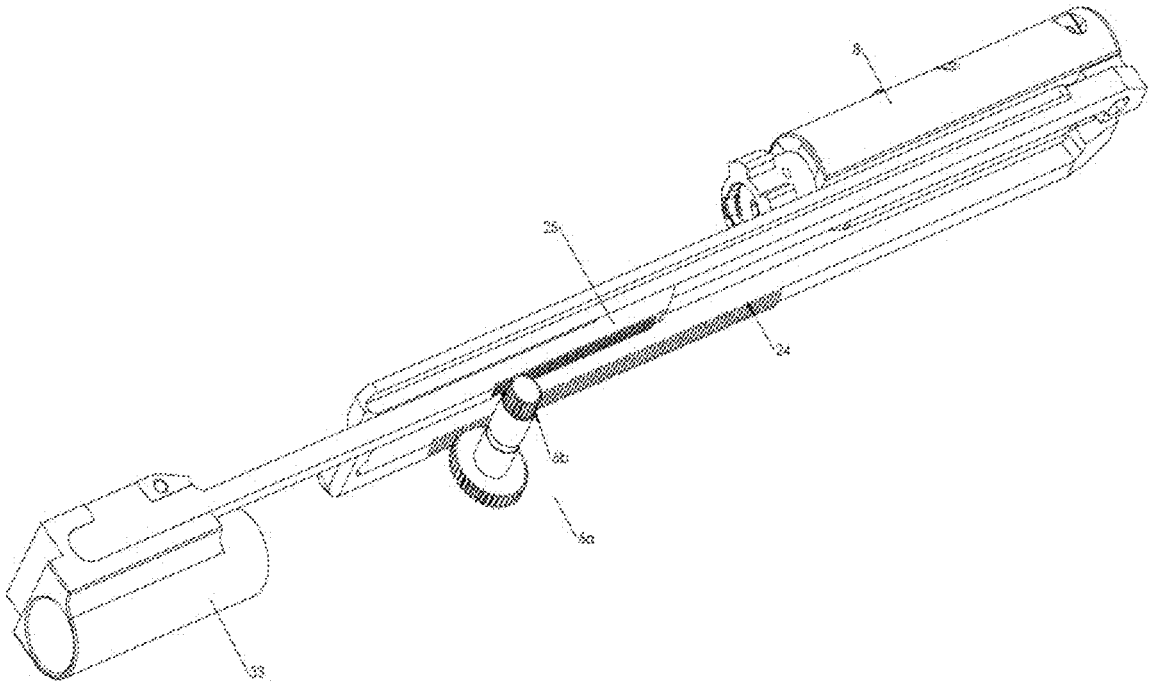
FIG. 8 is a view of the pump-action shotgun illustrating the short tensile slide and long tensile slide.

FIGS. 5 and 6 shows the pumping action from left to the right side in the step (i).

As a result of the operation mechanism of the inventive pump-action shotgun, the mechanism (8) fastened on the long tensile slide (24) moves a shorter distance than the standard pumping action. This ensures the shooter endeavors less by approximately 65 percent compared to those current pump-action shotguns. In the present invention, moving the forearm (32) only by 50 mm is sufficient to take completely the mechanism (8) backwards by approximately 120 mm (up to the backward movement) to extract the ammunition.

In the present invention, the pump comprises a short tensile slide (25) and long tensile slide (24) operating simultaneously together with the dual diameter of the gearwheel system (6). By means of the gearwheel system (6) mechanism, the movement only by 50 mm is sufficient to complete the pumping operation instead of the current longer pumping action. The same movements, however in the opposite direction, function for feeding/chambering a new ammunition or shotgun shell and lock the bolt (8) in the locking position with the barrel (1).

In an embodiment of the present invention, the gearwheel system (6) is manufactured from steel, however it can be manufactured from a different type of material. The gearwheel system (6) may be rigid or may be comprised of a single or multiple components.

In an embodiment of the present invention, diameter of 6*b* is in the range of 5-15 mm, preferably 9.5 mm and diameter of 6*a* is in the range of 5-35 mm, preferably 22 m.

In an embodiment of the present invention, the total length of the gearwheel system (6) is in the range of 5-50 mm, preferably 29.4 mm.

In an embodiment of the present invention, the length of the tension rods between the longer slide (24) and shorter slide (25) is in the range of 20-150 mm.

In an embodiment of the present invention, the long tensile slide (24) and short tensile slide (25) are manufactured from steel. Both of the slides may be rigid and may be comprised of two or more components.

The total length of the short tensile slide (25) is of 230 mm and the total length of the long tensile slide (24) is of 297 mm.

The invention claimed is:

1. A short-stroke (operation distance) pump-action shotgun with a reduced reloading path and consequently reduced reloading time, the short-stroke pump-action shotgun comprising:

a gearwheel system that allows for reducing a forearm movement and path in pump-action shotguns and consequently also reducing the reloading time, wherein the gearwheel system is fastened on a receiver by a retainer pin operating on a long tensile slide and a short tensile slide, is configured to operate co-centrally, and comprises two gearwheels of different diameters.

2. The short-stroke pump-action shotgun according to claim 1, wherein the pump-action shotgun is a pump-action shotgun with a rifled barrel or a smooth bore barrel.

3. The short-stroke pump-action shotgun according to claim 1, wherein the gearwheel system is in a single piece or comprised of two or more components.

4. The short-stroke pump-action shotgun according to claim 1, wherein the gearwheel system comprises a first gearwheel with a greater diameter and a second gearwheel with a smaller diameter.

5. The short-stroke pump-action shotgun according to claim 4, wherein the smaller diameter of the second gearwheel is in the range of 5-15 mm.

6. The short-stroke pump-action shotgun according to claim 5, wherein the smaller diameter of the second gearwheel is 9.5 mm.

7. The short-stroke pump-action shotgun according to claim 4, wherein the greater diameter of the first gearwheel is in the range of 5-35 mm.

8. The short-stroke pump-action shotgun according to claim 7, wherein the greater diameter of the first gearwheel is 22 mm.

9. The short-stroke pump-action shotgun according to claim 1, wherein a total length of the gearwheel system is in the range of 5-50 mm.

10. The short-stroke pump-action shotgun according to claim 9, wherein the total length of the gearwheel system is 29.4 mm.

11. The short-stroke pump-action shotgun according to claim 1, wherein the long tensile slide and the short tensile slide are a single piece or comprise two or more components.

12. The short-stroke pump-action shotgun according to claim 1, wherein the long tensile slide and the short tensile slide are manufactured from steel.

13. The short-stroke pump-action shotgun according to claim 1, wherein a tension rod on the long tensile slide has a length in the range of 20-150 mm.

14. The short-stroke pump-action shotgun according to claim 1, wherein a tension rod on the short tensile slide has a length in the range of 20-150 mm.

* * * * *